US011834937B2

(12) United States Patent
Herman

(10) Patent No.: US 11,834,937 B2
(45) Date of Patent: Dec. 5, 2023

(54) SYSTEMS AND METHODS FOR A BYPASS PLUNGER

(71) Applicant: EnerVest, Ltd., Houston, TX (US)

(72) Inventor: Daniel Jay Herman, Fort Worth, TX (US)

(73) Assignee: EnerVest, Ltd., Houston, TX (US)

( * ) Notice: Subject to any disclaimer, the term of this patent is extended or adjusted under 35 U.S.C. 154(b) by 0 days.

(21) Appl. No.: 17/836,427

(22) Filed: Jun. 9, 2022

(65) Prior Publication Data

US 2022/0397022 A1 Dec. 15, 2022

Related U.S. Application Data

(60) Provisional application No. 63/209,699, filed on Jun. 11, 2021.

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... E21B 43/121; F04B 47/12
See application file for complete search history.

(56) References Cited

U.S. PATENT DOCUMENTS 4,986,727 A * 1/1991 Blanton ..... F04B 47/12 417/58
6,637,510 B2 * 10/2003 Lee ..... E21B 34/08 166/372
7,784,549 B2 * 8/2010 Balen ..... E21B 37/10 166/372
9,790,772 B2 10/2017 Jefferies

* cited by examiner

*Primary Examiner* — Jonathan Malikasim
(74) *Attorney, Agent, or Firm* — Hogan Lovells US LLP

(57) ABSTRACT

A plunger assembly includes a cage having a body extending from a first end to a second end, the cage having a bore extending from the first end to the second end and one or more radial openings. The plunger assembly also includes a stinger positioned at least partially within the bore, the stinger being axially movable along an axis aligned with the bore between an open position and a closed position, wherein at least a portion of the stringer blocks at least a portion of the one or more radial openings in the closed position. The plunger assembly further includes a magnetic positioning system configured to hold the stinger in at least one of the open position or the closed position, the magnetic positioning system having one or more magnetic components that interact with at least one magnetic portion of the stinger.

18 Claims, 12 Drawing Sheets

SYSTEMS AND METHODS FOR A BYPASS PLUNGER

CROSS-REFERENCE TO RELATED APPLICATIONS

This application claims priority to and the benefit of U.S. Provisional Patent Application No. 63/209,699 filed Jun. 11, 2021 and titled "SYSTEMS AND METHODS FOR A BYPASS PLUNGER," the full disclosure of which is hereby incorporated in its entirety for all purposes.

BACKGROUND

1. Field of Disclosure

This disclosure relates in general to oil and gas tools, and in particular, to systems and methods for plunger lift recovery.

2. Description of the Prior Art

In exploration and production of formation minerals, such as oil and gas, artificial lift techniques may be incorporated to enhance production. One such method includes plunger lift systems, also known as free piston systems, where a plunger (e.g., piston) is dropped into a well by releasing it from a plunger catcher at the surface. The plunger is driven downward in the well by gravity until a bumper or stop is reached. The plunger may then block flow through the well, which increases pressure to drive the piston upwardly toward the surface, pushing liquid on top of the piston to the surface. Certain methods shut in the well to enable the piston to fall within the well, but alternative methods may include bypasses that open and close at different times so that the well is not shut in.

SUMMARY

Applicant recognized the limitations with existing systems herein and conceived and developed embodiments of systems and methods, according to the present disclosure, for improved artificial lift systems.

In an embodiment, a plunger assembly includes a cage having a body extending from a first end to a second end, the cage having a bore extending from the first end to the second end and one or more radial openings. The plunger assembly also includes a stinger positioned at least partially within the bore, the stinger being axially movable along an axis aligned with the bore between an open position and a closed position, wherein at least a portion of the stringer blocks at least a portion of the one or more radial openings in the closed position. The plunger assembly further includes a magnetic positioning system configured to hold the stinger in at least one of the open position or the closed position, the magnetic positioning system having one or more magnetic components that interact with at least one magnetic portion of the stinger.

In an embodiment, an artificial lift system includes a bumper assembly arranged within a wellbore, a rod assembly arranged within the wellbore, and a plunger assembly positioned within the wellbore. The plunger assembly includes a cage having a bore therethrough and one or more radial openings in fluid communication with the bore. The plunger assembly also includes a stinger positioned within the bore, the stinger being axially movable along an axis between an open position and a closed position, wherein at least a portion of the stringer blocks at least a portion of the one or more radial openings in the closed position. The plunger assembly further includes a magnetic positioning system configured to hold the stinger in at least one of the open position or the closed position. The stinger is driven between the open position and the closed position responsive to respective forces applied by the bumper assembly and the rod assembly.

In an embodiment, a method includes positioning a plunger assembly within a wellbore. The method also includes securing a stinger of the plunger assembly in an open position using a magnetic positioning system. The method further includes causing, responsive to a first force, the stinger to move to a closed position. The method also includes causing, responsive to a second force, the stinger to move to the open position after the stinger is driven to a top portion of the wellbore.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE DISCLOSURE

Figure 1:
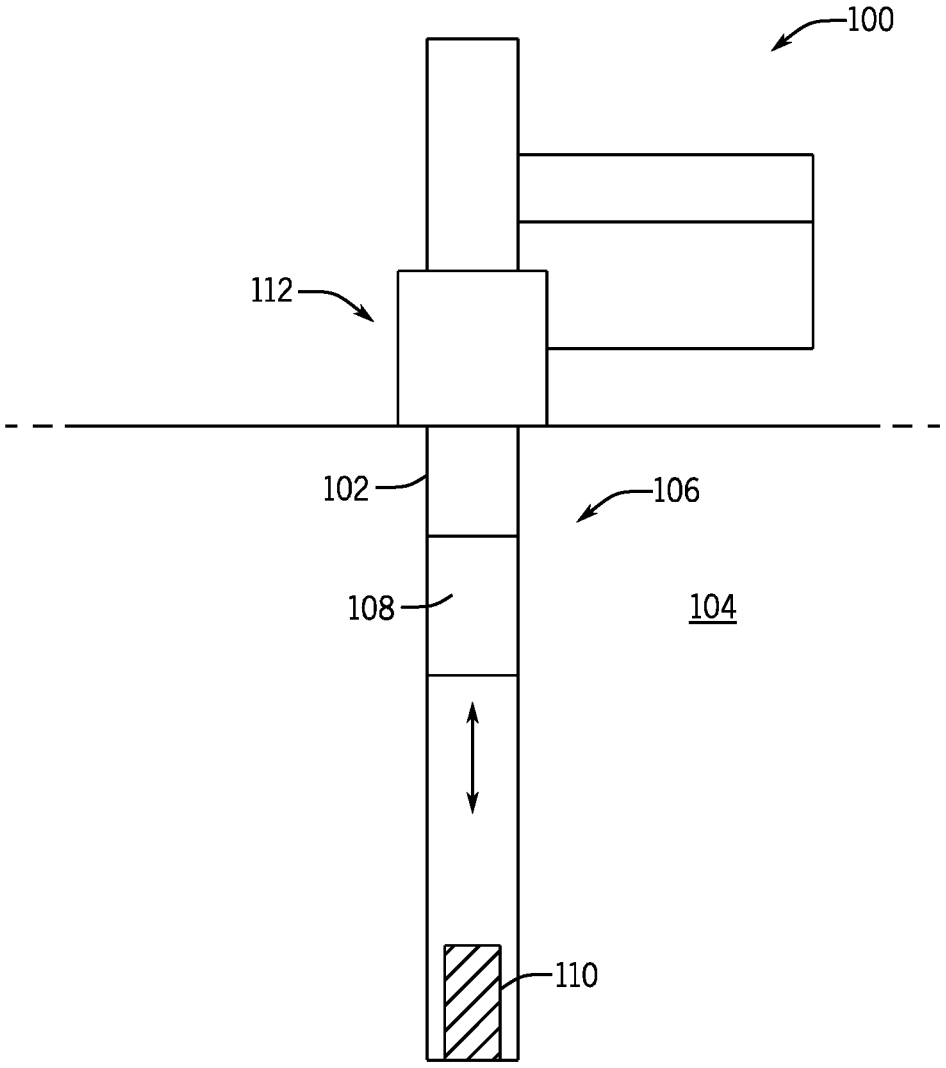
FIG. 1 is a schematic side view of an embodiment of a surface recovery operation, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward utilizing a magnetic force to hold a stinger (e.g., push rod) in place rather than metal coil springs, or bands, which are known to wear out. As a result, systems and methods are directed toward improvements to stingers to increase their lifespan. Moreover, embodiments of the present disclosure may be simpler and cheaper to manufacture due to including fewer moving pieces. Furthermore, systems and methods may be designed with smaller build tolerances, which may reduce a likelihood of corrosion within the system.

In at least one embodiment, systems and methods are directed toward utilizing one or more magnetic components arranged around a moving stinger. These one or more magnetic components may be used to hold the stinger in an open or closed position while operating in an oil and gas well. As a result, friction-based components may be eliminated, which may improve a life of the plunger assembly. Moreover, embodiments may enable tuning of the system by adjusting magnetic components utilized within the system to increase or decrease a resultant force to drive the stinger between the open position and the closed position.

Current bypass plungers in oil and gas wells are made of a system of springs or elastic bands (which may be referred to as a clutch) to loosely hold a moving stinger via friction. Over time, the springs, bands, and stingers wear due to friction and cause the bypass plunger to stop working. Embodiments of the present disclosure overcome these drawbacks by utilizing a design with reduced friction (e.g., a frictionless design) that incorporates a hybrid ferrous/nonferrous stinger held in open and closed positions by one or more magnetic components acting on the stinger. Embodiments may reduce or eliminate conventional springs or bands utilized with the clutch, therefore reducing the potential of wear and failure. In at least one embodiment, the plunger travels down tubing (e.g., tubing arranged within a well) with the stinger held in the open position by magnets acting on a magnetic ring attached to the non-magnetic stinger. By way of example only, the magnetic ring may include one or more magnetic or magnetized components that are responsive to a magnetic force of the magnets. Once the plunger contacts or engages a down hole spring assembly, the stinger is forced out of its open magnetic state and into a closed magnetic state, essentially sealing off the tubing. Pressure from the producing formation forces the plunger up to the surface where a stationary rod passes through the body of the plunger and impacts the top of the stinger, moving it from the closed magnetic state back to the open magnetic state. Once back in the open magnetic state, gas and liquids can travel through the plunger and gravity pulls the plunger back down the tubing until it hits the bottom hole spring assembly and the cycle continues. Various systems and methods are directed toward a stinger with an improved or increased useful life when compared to typical arrangements that utilize springs or elastic bands. Furthermore, systems and methods are directed toward a stinger that is easier to assemble due to a reduction in moving parts and, moreover, with tighter tolerances to reduce corrosion.

Various embodiments of the present disclosure overcome one or more problems associated with existing assemblies and methods. By way of example only, a plunger utilized in an artificial lift system may have a typical life of approximately 4,000 cycles. Over time, one or more components or features may break down due to wear or the spring/biasing components of a clutch lose their effectiveness across repeated cycles. For example, the clutch may hold tension while the stinger moves, with the bodies being held together by springs and/or bands. As the stinger reciprocates, the springs and/or bands may wear out and no longer hold the stinger between open and closed positions, thereby losing effective operation of the system due to the loss of friction between the components. The time a cycle takes may vary based on properties of the well, but operators may be spending significant capital on purchasing replacement plungers. Replacing stingers also comes with associated costs for shutting in the well, or performing some type of operation, to enable removal of the plunger. Embodiments of the present disclosure may overcome these problems by reducing a number of moving pieces utilized in the system, removing one or more wearable friction-based components, and integrating magnetic components into the system, which may have a longer life than friction-based components. Furthermore, various embodiments may reduce overall friction in the system by redesigning one or more components to eliminate friction grooves or ribbed sections that previously interacted with the springs and/or bands. In one or more embodiments, the present disclosure may include a stinger having a mixture of ferrous and non-ferrous components, where the specific materials may be particularly selected based on one or more design conditions. Embodiments may further be directed toward a low-friction system where one or more surfaces are substantially flushed or machined flat, thereby reducing a likelihood of friction or interaction with other components, which could lead to damage. Additionally, various embodiments enable tuning or adjustment of opening forces within the system by changing certain dimensions of the one or more magnetic components utilized within the system. In this manner, systems and methods may provide stingers that have a longer useful life and/or are more economical to manufacture.

In one or more embodiments, systems and methods replace existing clutches, which may be too large/heavy/thick to accommodate the friction forces and contact forces with smaller, lighter weight materials. For example, one or more components may be replaced with synthetic or plastic components. Additionally, because of the removal of components such as the bands/springs, features may be formed with a larger diameter to provide additional resistance to wear or impacts during operation. Removal of these components, such as the grooves along the stinger, may also provide tighter tolerances for manufacturing, which may desirably decrease corrosion within the system.

FIG. 1 is a schematic side view of an embodiment of a surface recovery operation 100. In this example, tubing 102 extends into a wellbore formed within a formation 104. The tubing may correspond to one or more wellbore tubulars, such as casing or production tubing, among other options. The illustrated embodiment includes an artificial lift system 106, such as a plunger lift system. A plunger 108 positioned within the tubing 102 is arranged to reciprocate along an axis of the tubing 102 and/or an axis of a portion of the wellbore. By way of example, the plunger 108 may be dropped or released into the tubing 102 and gravity may drive the plunger 108 downward until the plunger 108 engages a down hole spring or bumper assembly 110. Upon engaging the assembly 110, fluid may collect above the plunger 108 until pressure builds in the wellbore 108 to drive the plunger 108 vertically upward toward a surface assembly 112, which may include various components such as a plunger catch, controllers, valves, piping, and the like. At or near the surface, one or more components may engage the plunger 108 to enable the plunger 108 to travel back down toward the assembly 110. As an example, the plunger 108 may continue to move upward until a bypass is reached, where the pressure may be relieved to enable further movement of the plunger 108 back down the hole. In at least one embodiment, the plunger 108 may include one or more moving components that travel between an open position, which permits flow by and/or through the plunger 108 and a closed position, which blocks the flow. Certain embodiments may include one or more components to drive the plunger between the open and closed positions, thereby enabling continued recovery.

Figure 2:
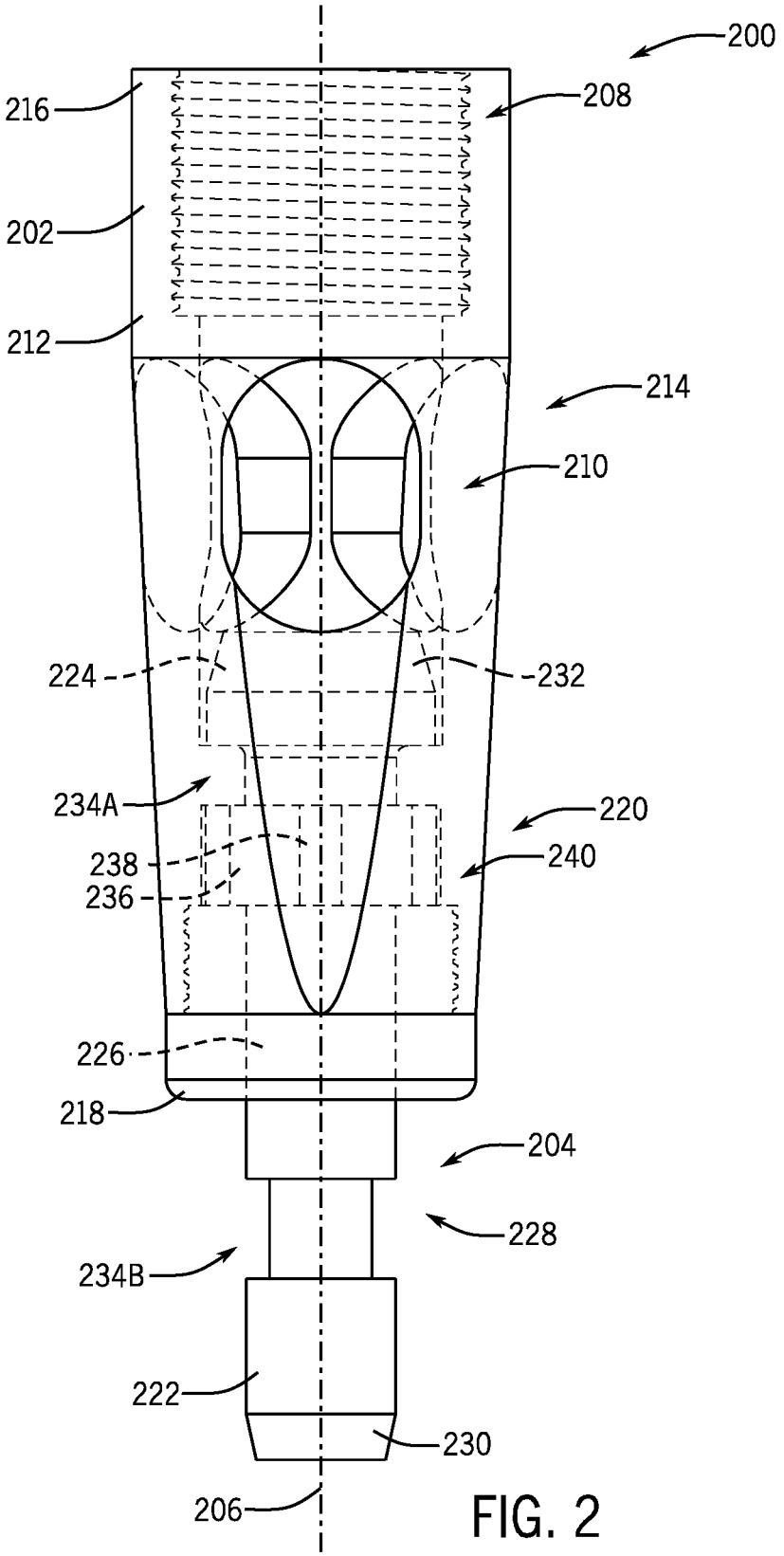
FIG. 2 is a schematic side view of an embodiment of a plunger assembly, in accordance with embodiments of the present disclosure.

FIG. 2 is a side view of an embodiment of a plunger assembly 200, which may also be referred to as a clutch or clutch assembly in various embodiments. In this example, a cage 202 is shown as semi-transparent for clarity with the following discussion. It should be appreciated that, in various embodiments, one or more components of the plunger assembly 200 may be integrated or otherwise associated with other components, and as a result, groupings of components may be referred to as the "clutch" or as the stinger, however, for clarity with the following discussion, individual components may be utilized for systems that may include multiple parts, and such a description is done for convenience and clarity and not to limit the embodiments of the present disclosure. In operation, a stinger 204 may be axially moveable along a stinger axis 206, for example responsive to an external force applied to the stinger 204, such as by contacting a bottom hole bumper (not shown) or by a push rod that engages the stinger (not shown). In at least one embodiment, the stinger axis 206 may be aligned or otherwise positioned along a wellbore axis such that the stinger 204 moves along the wellbore, as will be described below.

In this example, the cage 202 includes a bore 208 that receives the stinger 204. The cage 202 further includes openings 210 (e.g., apertures, flow passages, etc.) arranged to extend radially through a body 212 of the cage 202. In this example, the openings 210 have an oval or circular shape, but it should be appreciated that various other shapes may be used in embodiments. Furthermore, a size or number of openings 210 may be varied based, at least in part, on expected design conditions. Additionally, arrangement of the openings 210 circumferentially and substantially aligned about the cage 202 is also by way of example and there may be numerous rows of openings or the openings may be offset to facilitate flow. Flow into the openings 210, and subsequently through the cage 202 along the stinger axis 206 may be permitted or blocked based, at least in part, on a position of the stinger 204. In this example, the stinger 204 is arranged in an open position such that flow is permitted through the openings 210. That is, the stinger 204 is not axially shifted (e.g., along the stinger axis 206) to block flow through the openings 210, as it would be in a closed position (not pictured). The arrangement illustrated in FIG. 2 may be utilized as the plunger assembly 200 is dropped or otherwise released into a wellbore and then, via gravity, travels down until it contacts a bottom hole bumper (not pictured) which applies a force to the stinger 204, thereby driving the stinger 204 in an axially upward direction along the stinger axis 206, thereby moving at least a portion of the stinger 204 to block or otherwise restrict flow through the openings 210.

It should be appreciated that various components and dimensions of the cage 202 may be particularly selected based on one or more operating or expected wellbore conditions. By way of example only, the illustrated cage 202 includes a tapered profile 214. In this example, the tapered profile 214 is larger at a top 216 (e.g., axially closer to the surface when in a vertical or substantially vertical position) than at a bottom 218 (e.g., axially further to the surface when in a vertical or substantially vertical position). However, it should be appreciated that the profile 214 may be tapered in another direction, may be an hourglass shape, may have similar or substantially similar dimensions at both the top 216 and bottom 218, or some combination thereof. Furthermore, it should be appreciated that the position of the openings 210 may also be particularly selected based on operating conditions, such as a desired travel of the stinger 204, a length of the stinger 204, a length of the body 212, and the like. Additionally, the openings 210 may be different sizes and the size may vary based on one or more operating conditions, as noted above. In this manner, the cage 202 may be designed for different expected operating conditions to enhance recovery.

In at least one embodiment, the stinger 204 may be formed from a hybrid or combination of both magnetic and non-magnetic, and a magnetic positioning system 220 may be utilized to hold the stinger 204 in an open position and/or a closed position. In this example, the stinger 204 includes a bottom end 222, a top end 224, and a connecting portion 226, where the connecting portion 226 has a variable diameter section 228. The bottom end 222 is arranged to engage or contact the bottom hole bumper, which translates force into the stinger 204 to move the stinger 204 axially upward along the axis 206 and to the closed position. In one or more embodiments, the bottom end 222 includes a tapered portion 230, which may facilitate force transfer when contacting the bottom hole bumper. Furthermore, because the tapered portion 230 is likely to receive force from the bottom hole bumper throughout the life of the stinger 204 (which may account for thousands of contacts), the taper may enable deformation, such as deformation radially outward, without deforming the bottom end 222 to a point where movement of the stinger 204 is impeded. In one or more embodiments, the bottom end 222 may be formed from a non-ferrous material.

The top end 224 similarly includes a tapered portion 232, which may also enable some deformation due to contact with one or more rods that engage the top end 224 to move the stinger 204 from a closed position (not pictured) to the illustrated open position. Furthermore, in at least one embodiment, the top end 224 is tapered to a matched surface which forms a positive seal to a main plunger body. In one or more embodiments, the top end 224 and the bottom end 222 may be different sizes, that is, the top end 224 and the bottom end 222 may have different diameters. It should be appreciated that such an arrangement is illustrative and may vary based on one or more design or expected operating conditions.

Further illustrated along the stinger 204 is the connecting portion 226 with the variable diameter sections 228. The variable diameter sections 228 may also be referred to as having grooves 234, where a first groove 234A may be proximate the top portion 224 and a second groove 234B may be proximate a bottom portion 222. In one or more embodiments, there may be more or fewer grooves 234, and moreover, groove sizes (e.g., length, depth, etc.) may be particularly selected and varied based on design or operating conditions. While not illustrated in FIG. 2, the grooves 234 may receive one or more bands or rings that are formed from a magnetic material, as opposed to the non-magnetic material that forms the stinger 204. In at least one embodiment, a size of the bands or rings may determine how much magnetic force is transmitted by the magnetic positioning system 220. In at least one embodiment, a position of the bands or rings may determine how early the system 220 is engaged or how much force is utilized to move between the open position and closed position. As a result, locations of the grooves 234A, 234B may be particularly selected and adjusted to tune or otherwise adjust the system 220. In this example, the surface of the stinger 204 is substantially smooth, in that various ridges or friction elements are not included, as with traditional stingers. It should be appreciated that such a configuration may reduce friction within the system to improve the working life of the stinger 204, but various embodiments may continue to incorporate one or more friction elements.

In at least one embodiment, a matrix 236 (e.g., carrier, carrier matrix, etc.) may be arranged within the cage 202 to position and secure one or more magnetic components. In at least one embodiment, the matrix 236 is formed from a non-ferrous material, such as a plastic, to reduce weight and construction costs, and may include one or more slots or channels 238 to receive and support the one or more magnetic components. Moreover, the matrix 236 may be formed from a material that will not affect or otherwise distort the magnetic forces of the one or more magnetic components. It should be appreciated that each slot or channel 238 may not be filled with the one or more magnetic components, and in various embodiments, magnetic components may be added or removed to adjust operation of the magnetic positioning system 220, such as to reduce or increase an applied magnetic force. In at least one embodiment, a groove or recessed portion 240 is formed within the cage 202 to receive and support the matrix 236, which may be a stationary component. It should be appreciated that, in one or more embodiments, the position of the matrix 236 is particularly selected based, at least in part, on other dimensions of the system to drive engagement of the one or more magnetic components with the bands or rings to secure the stinger 204 between the open position and the closed position.

Figure 3:
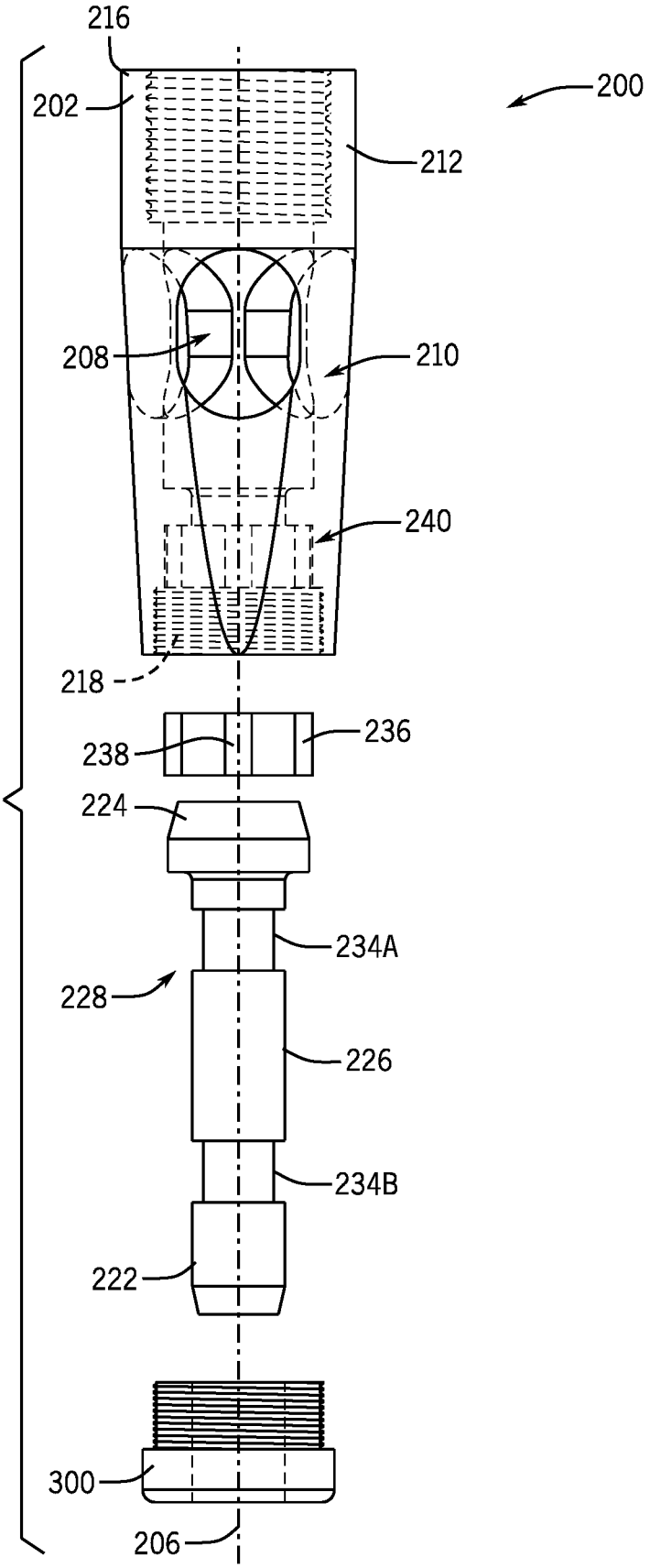
FIG. 3 is a schematic exploded side view of an embodiment of a plunger assembly, in accordance with embodiments of the present disclosure.

FIG. 3 is an exploded side view of an embodiment of the plunger assembly 200. In this example, the body 212 of the cage 202 is still illustrated as partially transparent in order to illustrate details of the cage 202, such as the internal channels (e.g., the bore 208, the recessed portion 240) and also the circumferential arrangement of the openings 210. For example, in this example, the openings 210 are positioned circumferentially about the axis 206 to include a total of four openings 210, but it should be appreciated that more or fewer openings 210 may be used in one or more embodiments. Furthermore, it should be appreciated that the openings 210 may also be arranged entirely on one side or in other patterns, and an evenly spaced circumferential arrangement is also illustrated by way of example only. Moreover, in one or more embodiments, a size of the openings 210 may be particularly selected, for example, to change a drop speed. Accordingly, it should be appreciated that various components may be adjusted based on design or operating conditions. In at least one embodiment, cage 202 further includes fastening components, illustrated as threaded components, for coupling to other tools, such as a cap 300. There may also be an additional cap at the top 216. Furthermore, in one or more embodiments, a main plunger body may be secured to the top 216, as will be described below.

In operation, the matrix 236 is positioned within the bore 208, for example within the recessed portion 240, to provide one or more magnetic components for use with the stinger 204. In at least one embodiment, the one or more channels or slots 238 of the matrix 236 are arranged circumferentially about the axis 206 and may be evenly spaced. It should be appreciated that alternative configurations may also be utilized, that more or fewer magnets may be used, and that various types of magnetic components may be used, including but not limited to rare earth magnetics, electromagnetics, and the like. It should be appreciated that a variety of systems and methods may be deployed in order to utilize magnetic and/or magnetized material and that systems and methods are not limited to the use of a particular arrangement or means. Further, mixed magnetic systems may also be utilized, such as rare earth magnetics along with electromagnets, by way of example only. In at least one embodiment, diametrically magnetic magnets may also be incorporated into the system, where at least a portion of the cage 202 is removed to house the magnets. That is, the magnetic components may be directly installed within the cage 202 in place of, or in addition to, the matrix 236. The magnets may be arranged such that the pole positions provide a different, or an alternative, magnetic force to the stinger 204, and specifically, to the bands or rings positioned along the stinger at the grooves 234. Moreover, the magnets may be arranged such that the pole positions point in the same direction. In at least one embodiment, combinations of magnetic arrangements may be used in order to adjust an opening or closing force used with the stinger 204.

FIG. 3 further illustrates the stinger 204 having the bottom end 222, top end 224, and connection portion 226 (e.g., connecting portion) with the variable diameter section 228 forming the grooves 234A, 234B. While not pictured in FIG. 3, one or more bands or rings may be added at the grooves 234A, 234B in order to interact with the one or more magnetic components associated with the matrix 236. As a result, the stinger 204 may be held at a predetermined position until an external force (e.g., a contact force, a signal to disengage an electronic magnetic, a certain fluid pressure, etc.) acts to break or overcome the magnetic force. As noted above, various dimensions may be adjusted, such as the outer dimensions of the various components. It may be desirable to include components with large outer dimensions in order to decrease spaces between adjacent components, which may help to reduce corrosion. Furthermore, thicker, stronger components may last longer due to the repeated forces as the stinger 204 moves between the top and bottom of the well.

Figure 4:
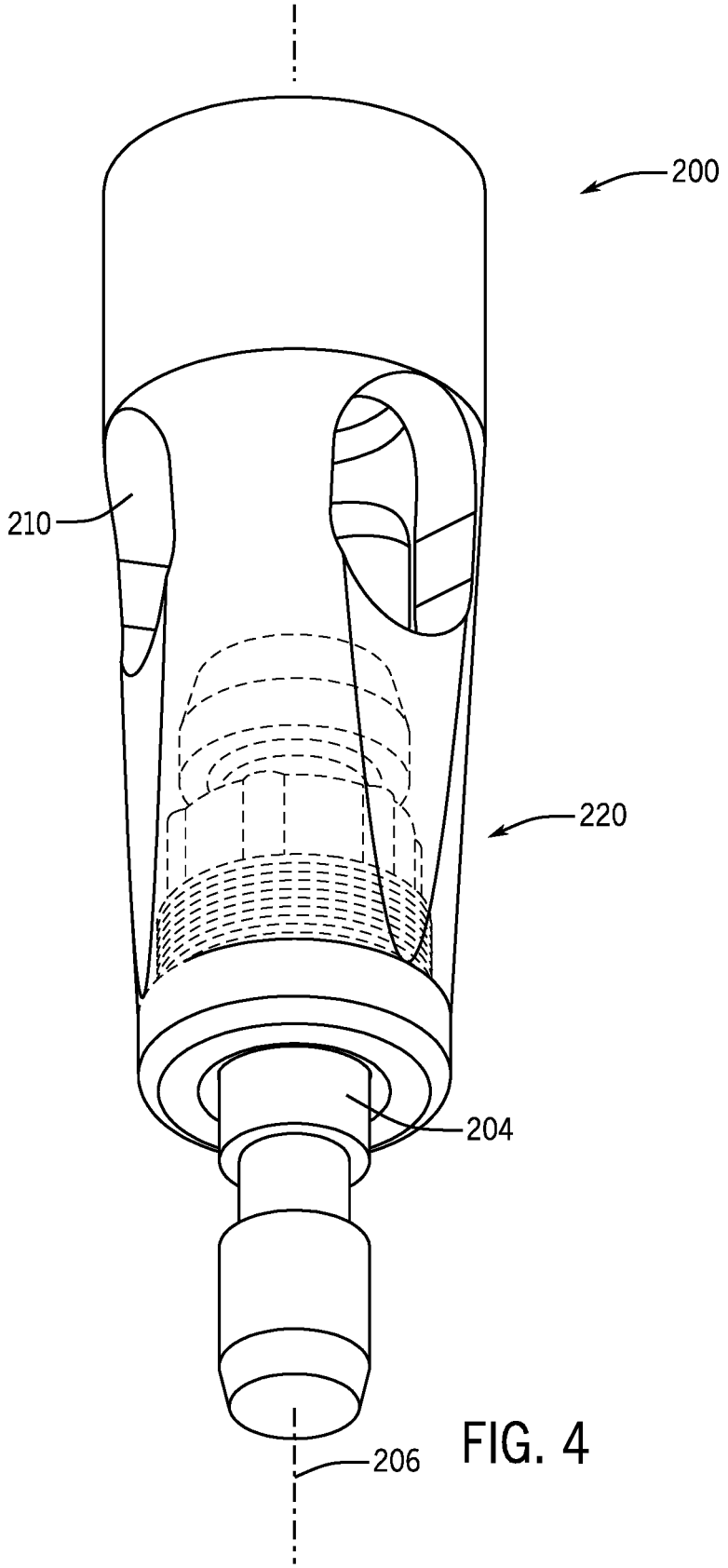
FIG. 4 is a perspective view of an embodiment of a plunger assembly, in accordance with embodiments of the present disclosure.
Figure 5:
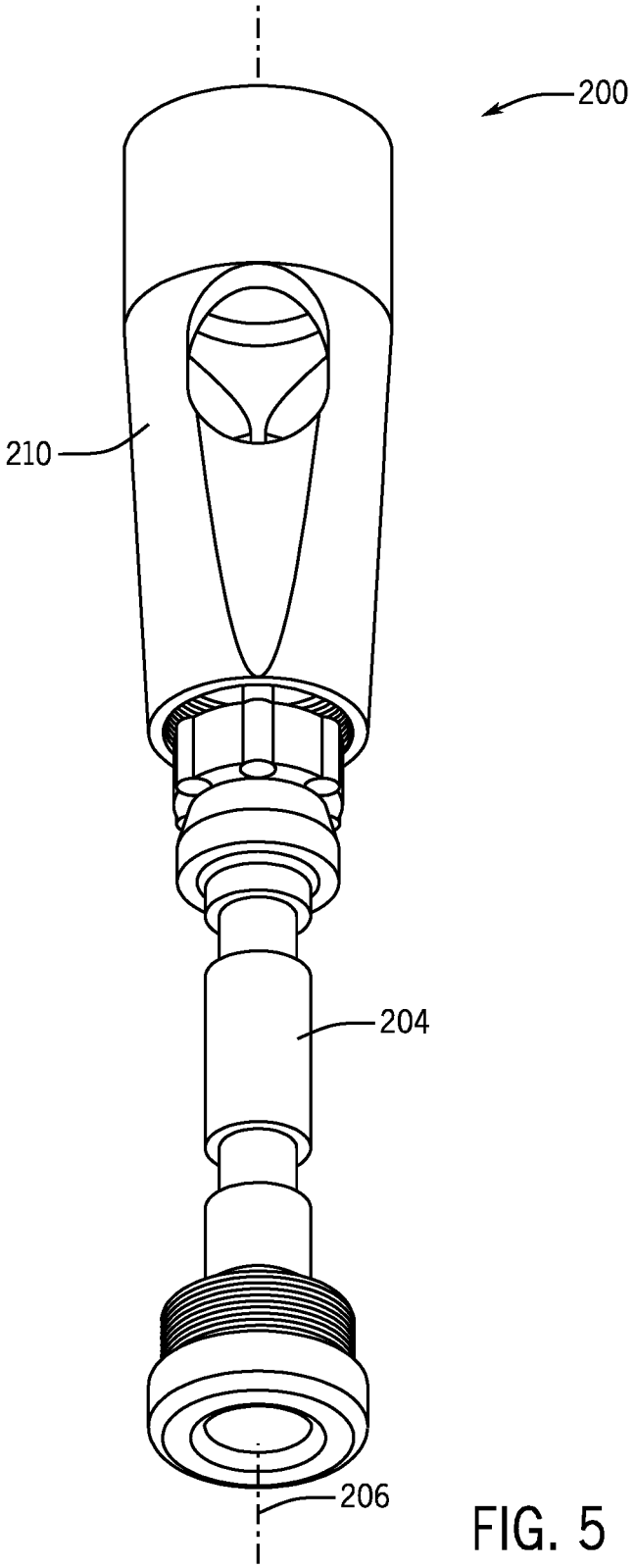
FIG. 5 is an exploded perspective view of an embodiment of a plunger assembly, in accordance with embodiments of the present disclosure.

FIGS. 4 and 5 are perspective views of the plunger assembly 200, where FIG. 5 is further an exploded perspective view. As noted above, various embodiments of the present disclosure enable the stinger 204 to move axially along the stinger axis 206 between an open position (shown) and a closed position (not shown) to block or permit fluid flow through the openings 210. The magnetic positioning system 220 may be utilized to hold the stinger 204 at a certain position until one or more conditions, such as an external force, drives the stinger 204 to a different position. Such an arrangement may eliminate one or more moving parts associated with traditional assemblies and may also provide a more robust design by eliminating various grooves, ribbed portions, seals, windings, and the like.

Further illustrated are the slots 238 formed in the matrix 236 and arranged in a circumferential configuration in which individual slots 238 are eventually spaced apart and separated by material forming the matrix 236. As noted, the arrangement of the slots 238 may be selected based on design conditions and the illustration of an even configuration is by way of example only. Furthermore, it should be appreciated that each slot 238 may not be the same size (e.g., may have a different circumferential extent) and moreover may not each be filled with a magnetic component. By way of example, the slots 238 may be differently sized with sizes corresponding to different types of magnets, where the different sizes may facilitate installation and assembly by reducing a risk of improper installation where certain magnets do not fit in the wrong location.

Figure 6C:
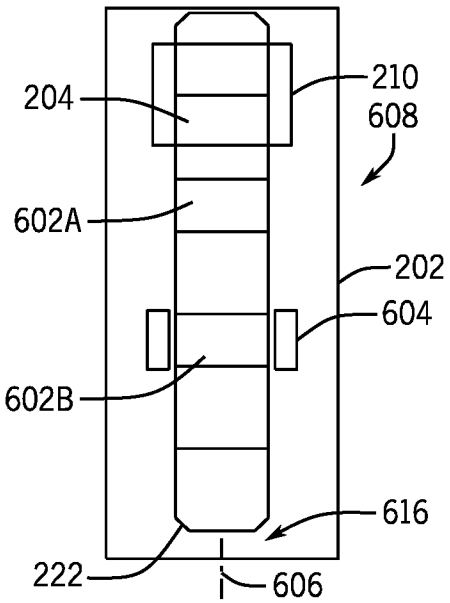
FIGS. 6A-6E are schematic cross-sectional views of an embodiment of a plunger assembly moving between an open position and a closed position, in accordance with embodiments of the present disclosure.
Figure 6B:
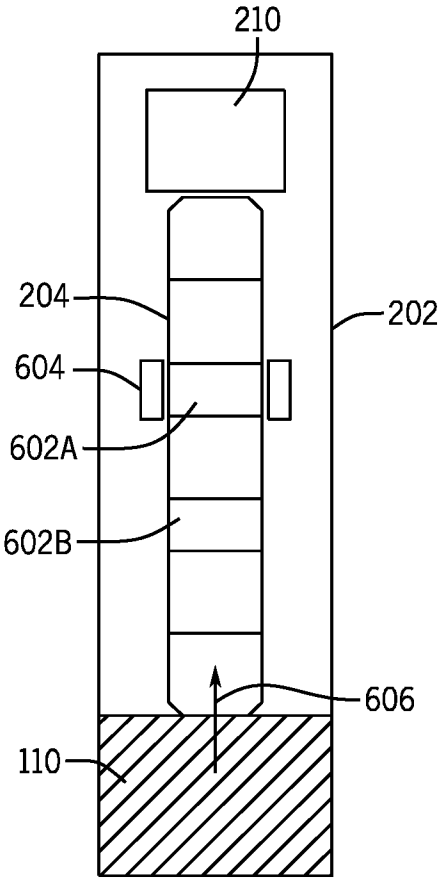
Figure 6A:
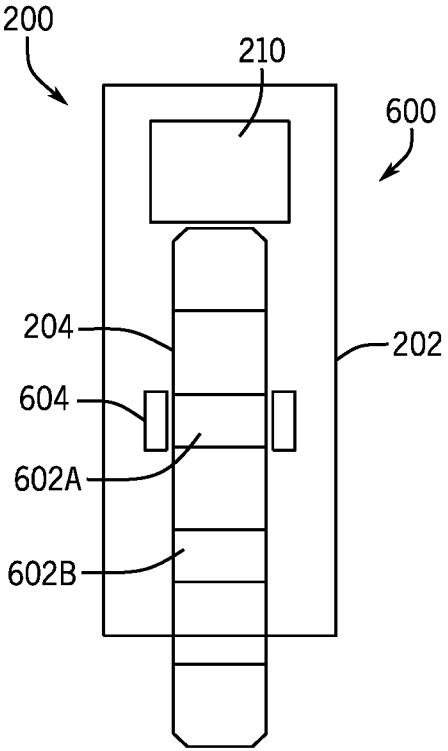
Figure 6E:
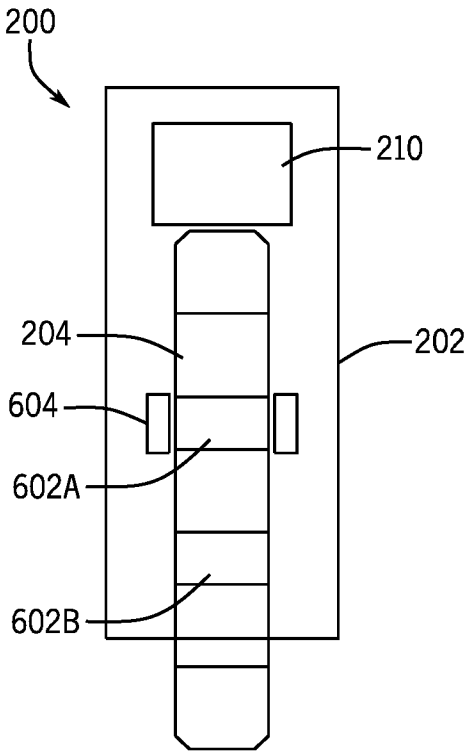
Figure 6D:
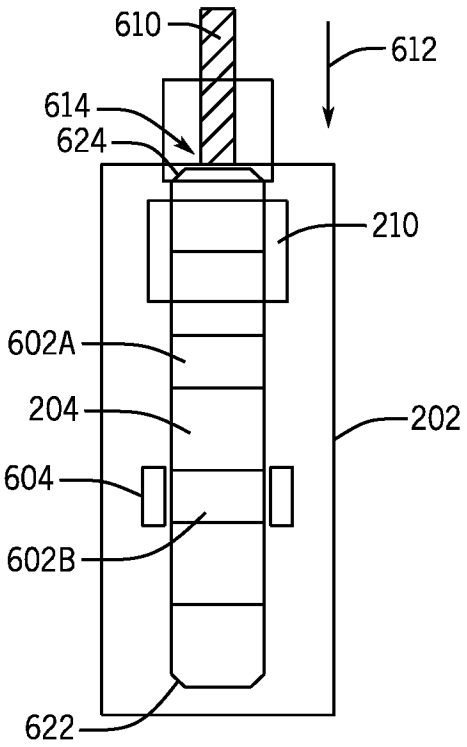

FIGS. 6A-6E are schematic cross-sectional side views of a sequence of events for moving the stinger 204 between an open position and a closed position. It should be appreciated that the sequence is simplified and may eliminate various components for clarity. In this example, the plunger assembly 200 includes the stinger 204 held in an open position 600 by the magnetic positioning system 200. The stinger 204 includes bands or rings 602 within the grooves 234 that interact with magnetic components 604 associated with the matrix (not pictured). In FIG. 6A, the magnetic positioning system engages the ring 602A, associated with groove 234A, to hold the stinger 204 in a position where the stinger 204 does not block or otherwise restrict flow into the opening 210. As a result, flow may continue up the wellbore, enabling the plunger assembly 200 to move in a downward direction (e.g., toward a bottom of the wellbore). As noted above, a force applied by the magnetic components 604 to the rings 602 may be sufficient to hold the stinger 204 in place until acted upon by an external force having a sufficient quantity of energy to overcome the magnetic components. Alternatively, or in addition, the magnetic force may be removed or eliminated, for example in embodiments where electromagnets are used, among other options. In FIG. 6B, the stinger 204 contacts the bumper assembly 110, which applies a force 606 to the stinger 204. In one or more embodiments, the force 606 is sufficient to overcome the magnetic force between the components 604 and the ring 602A, thereby driving the stinger 204 in an axially upward direction (e.g., toward the surface, away from the bumper assembly 110). FIG. 6C illustrates a resultant position of the stinger 204 in a closed position 608 where the ring 602B, associated with the groove 234B, is now engaged with the components 604, thereby securing the stinger 204 in the closed position 608. In this position, the stinger 204 moves in the axially upward direction, along the axis 206, so that at least a portion of the stinger 204 now blocks at least a portion of the openings 210. In certain embodiments, the stinger 204, or at least a portion of the stinger 204, may seal against or otherwise engage a mating surface to block flow through the openings 210. As pressure builds, the plunger assembly 200 is transported axially upward, away from the bumper assembly 110, toward a surface location. FIG. 6D illustrates a rod 610 that may engage the stinger 204, applying a force 612 that overcomes the magnetic force between the ring 602B and the components 604, thereby driving the stinger 204 back to the open position 600. It should be appreciated that the illustrated embodiment is a simplified version and various features have been removed for clarity. By way of example, the stinger 204 may be coupled to a main plunger body, which may transmit the force received from the rod 610 and/or provide a passage for the rod 610 to transmit the force. Furthermore, in one or more embodiments, the top end 224 includes the taper that forms a seal with the main plunger body. Accordingly, embodiments of the present disclosure are provided to illustrate movement of the stinger 204 driven by the magnetic sealing system 200.

In one or more embodiments, the top end 224 may be positioned below or not flush with the top 216 of the cage 202. By way of example only, FIGS. 6C and 6D illustrate a gap 614 or recess of the top end 224 with respect to the top 216 of the cage 202. Such an arrangement may be advantageous because at least a portion of the force provided by the rod 610 may be absorbed by the cage 202, thereby decreasing wear and deformation on the top end 224. Furthermore, this may enable a main plunger body to extend, at least partially, into the cage 202 and form a connection, for example a threaded connection, such that the top end 224 may seal against the main plunger body. Such a configuration may be enabled by tuning the magnetic forces associated with the magnetic positioning system 220 to reduce a force needed to return the stinger 204 to the open position.

In one or more embodiments, the bottom end 222 may be positioned below or not flush with the bottom 218 of the cage 202 and/or the cap 300. By way of example only, FIG. 6C illustrates a gap or recess 616 of the bottom end 222 with respect to the bottom 218 of the cage 202 and/or the cap 300. Such an arrangement may be advantageous because at least a portion of the force provided by the bumper assembly 110 may be absorbed by the cage 202 and/or the cap 300, thereby decreasing wear and deformation on the bottom end 222.

Figure 7A:
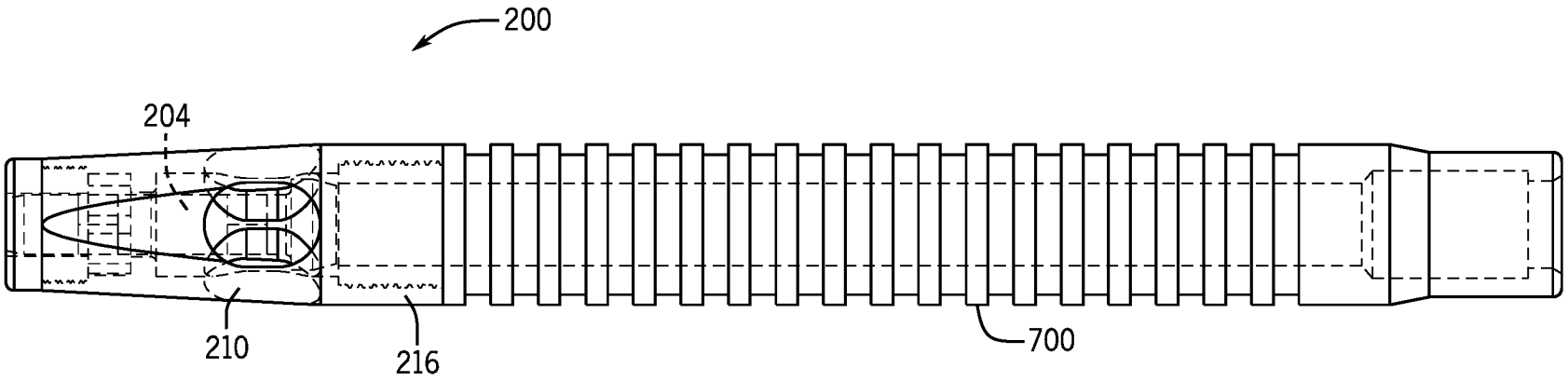
FIGS. 7A-7D are schematic views of an embodiment of a plunger assembly, in accordance with embodiments of the present disclosure.
Figure 7B:
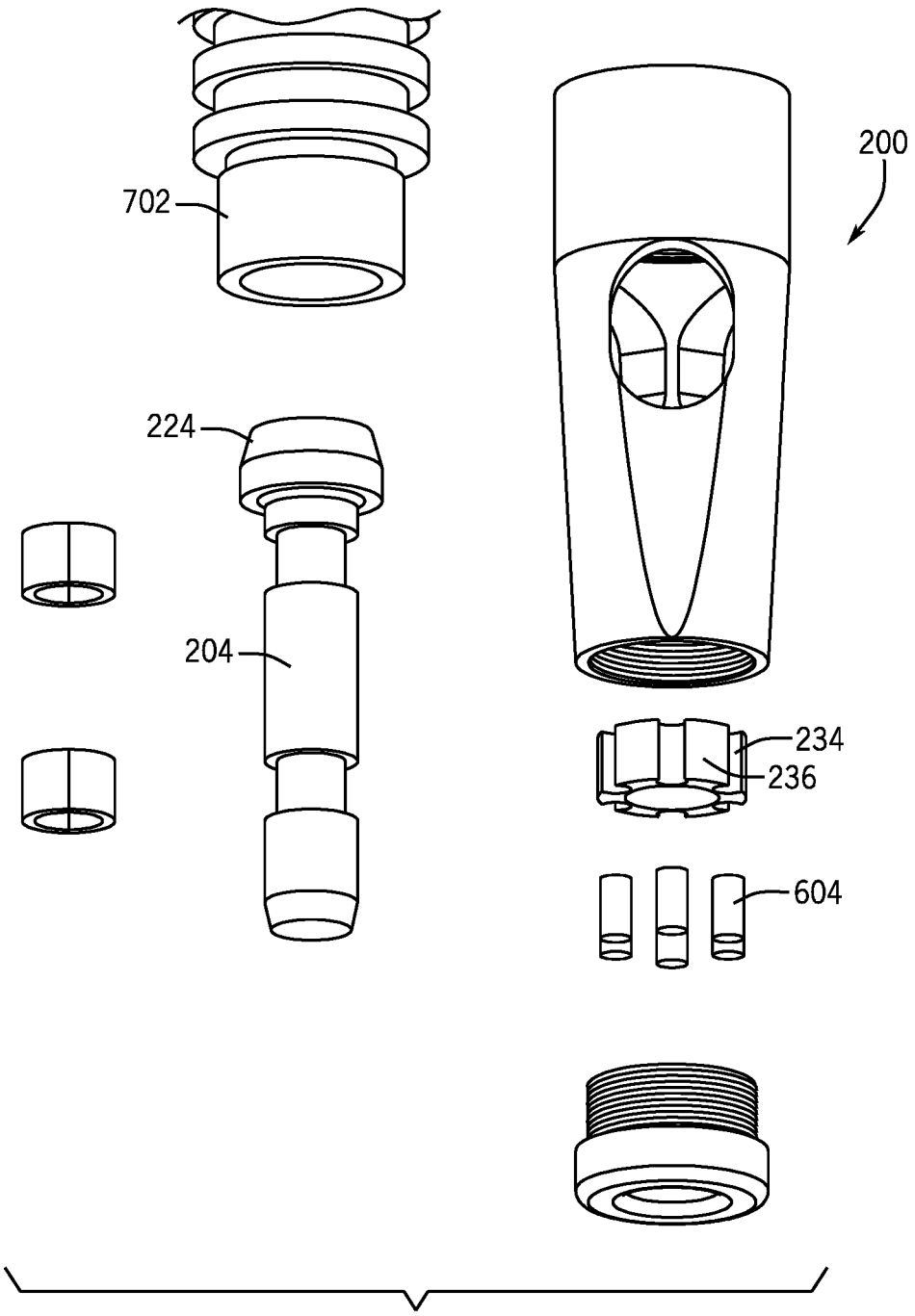

FIGS. 7A-7D illustrate embodiments of the plunger assembly 200 including a main plunger body 700, which may be coupled to the plunger assembly 200, for example at the top 216. FIG. 7A illustrates the plunger assembly 200 in a closed position where the main plunger body 700 is secured at the top 216. In this example, the stinger 204 is arranged such that flow through the openings 210 is blocked. FIG. 7B illustrates an exploded view of the plunger assembly 200 decoupled from the main plunger body 700. In this example, the tapered top end 224 is shown to correspond to a mating taper 702 within the main plunger body 700. Further illustrated are the magnetic components 604 arranged proximate their respective grooves 234 of the matrix 236.

Figure 7C:
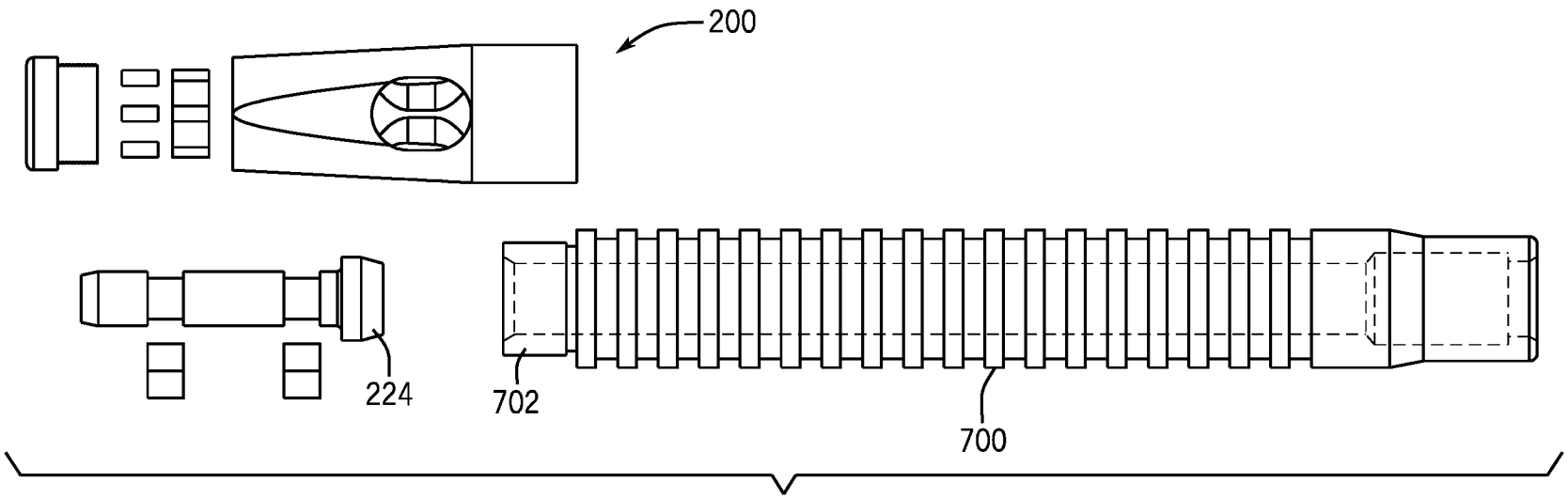
Figure 7D:
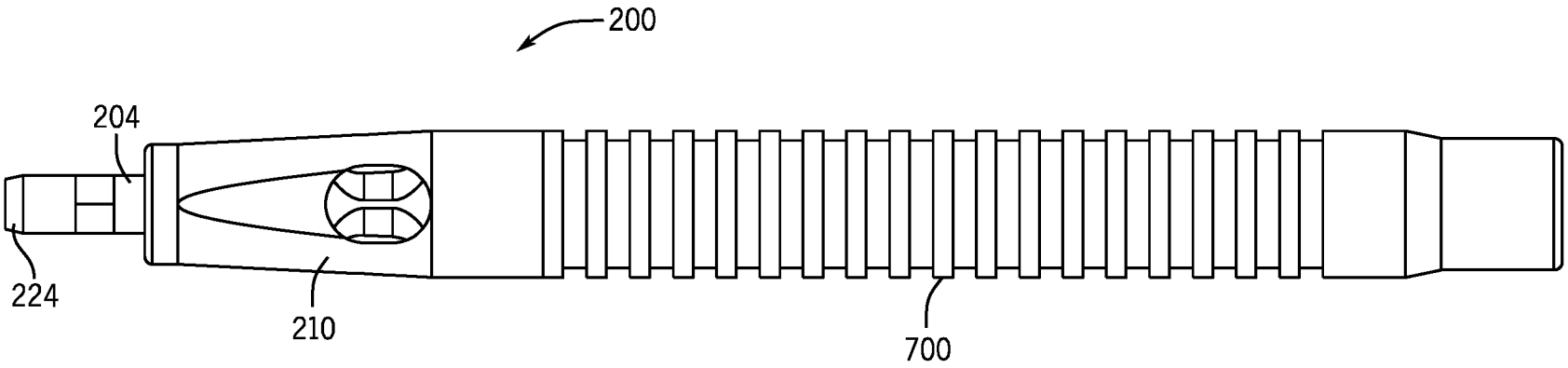

FIG. 7C illustrates another exploded view further illustrating the mating taper 702 and main plunger body 700, as well as various components described herein with respect to the plunger assembly 200. FIG. 7D illustrates the plunger assembly 200 in the open position where the plunger 204 extends beyond the cap 300. In this example, flow is permitted through the openings 210.

Figure 8:
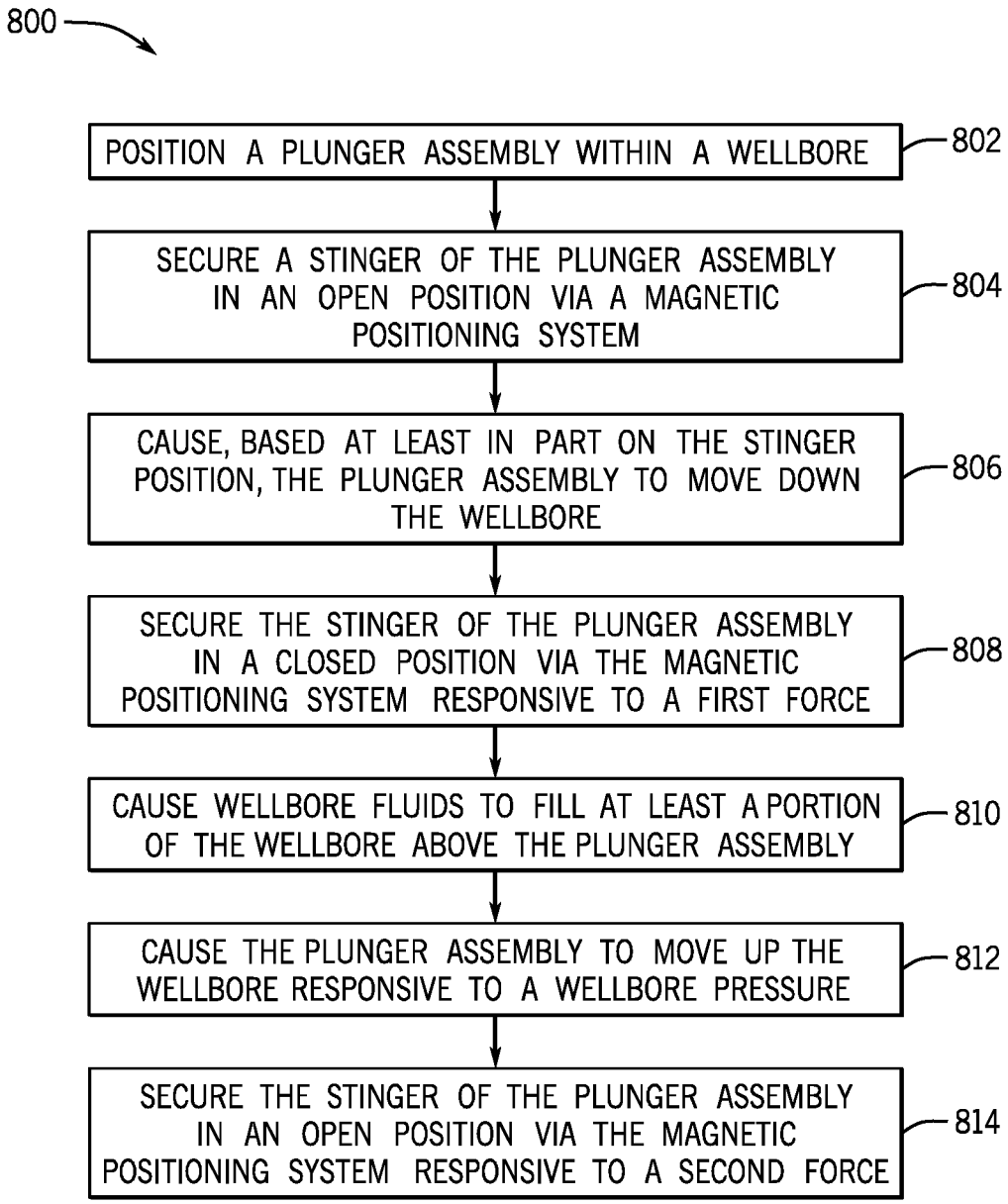
FIG. 8 is a flow chart of an embodiment of a method for artificial lift, in accordance with embodiments of the present disclosure.

FIG. 8 is a flow chart of an embodiment of a method 800 for performing artificial lift in a wellbore. It should be appreciated that for this method, and all methods described herein, that there may be more or fewer steps. Additionally, the steps may be performed in any order, or in parallel, unless otherwise specifically stated. In this example, a plunger assembly is positioned within a wellbore 802. A stinger of the plunger assembly is secured in an open position via a magnetic positioning system 804. By placing the stinger in the open position, fluid may flow through the plunger assembly, thereby causing the plunger assembly to move down the wellbore 806. In at least one embodiment, the stinger may contact a bumper or spring at the bottom of the wellbore, which may apply an external force to drive the stinger into a closed position, which may be retained by the magnetic positioning system 808. The stinger in the closed position may block flow through the plunger assembly, which may cause accumulation above the plunger assembly 810 and eventually cause pressure build up to drive the plunger assembly toward the surface 812. At the surface, an external force may be applied to the stinger to transition the stinger back to the open position 814. In this manner, the plunger may repeatedly move up and down the wellbore to facilitate enhanced wellbore fluid recovery.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A plunger assembly, comprising:

a cage having a body extending from a first end to a second end, the cage having a bore extending from the first end to the second end and one or more radial openings;

a stinger positioned at least partially within the bore, the stinger being axially movable along an axis aligned with the bore between an open position and a closed position, wherein at least a portion of the stinger blocks at least a portion of the one or more radial openings in the closed position, and the stinger includes a top end, a bottom end, and a connecting portion, the connecting portion having one or more grooves that receive one or more rings, the one or more rings being formed of a magnetic material; and a magnetic positioning system configured to hold the stinger in at least one of the open position or the closed position, the magnetic positioning system having one or more magnetic components that interact with at least one magnetic portion of the stinger, wherein the at least one magnetic portion of the stinger comprises the magnetic material.

2. The plunger assembly of claim 1, wherein the one or more grooves include two grooves axially spaced apart along the stinger, a first ring of the one or more rings being positioned within a first groove and a second ring of the one or more rings being positioned within a second groove.

3. The plunger assembly of claim 2, wherein alignment between the first ring and the one or more magnetic components corresponds to the open position and alignment between the second ring and the one or more magnetic components corresponds to the closed position.

4. The plunger assembly of claim 1, further comprising:

a matrix positioned within a recess of the cage, the matrix having one or more slots to receive and support the one or more magnetic components.

5. The plunger assembly of claim 4, wherein the one or more slots comprises a plurality of slots equally spaced about a circumference of the matrix.

6. The plunger assembly of claim 4, wherein at least a portion of the stinger is circumferentially surrounded by the matrix.

7. The plunger assembly of claim 1, wherein a bottom portion of the stinger is tapered.

8. The plunger assembly of claim 1, wherein a top portion of the stinger is tapered, the top portion corresponding to a mating taper of a body section, the body section being coupled to the cage.

9. An artificial lift system, comprising:

a bumper assembly arranged within a wellbore;

a rod assembly arranged within the wellbore; and a plunger assembly positioned within the wellbore, the plunger assembly comprising:

a cage having a bore therethrough and one or more radial openings in fluid communication with the bore;

a stinger positioned within the bore, the stinger being axially movable along an axis between an open position and a closed position, wherein at least a portion of the stinger blocks at least a portion of the one or more radial openings in the closed position;

a magnetic positioning system configured to hold the stinger in at least one of the open position or the closed position; and a matrix positioned within a recess of the cage, the matrix having one or more slots to receive and support one or more magnetic components associated with the magnetic positioning system;

wherein the stinger is driven between the open position and the closed position responsive to respective forces applied by the bumper assembly and the rod assembly.

10. The artificial lift system of claim 9, wherein the stinger includes a top end, a bottom end, and a connecting portion, the connecting portion having one or more grooves that receive one or more rings, the one or more rings being formed of a magnetic material.

11. The artificial lift system of claim 10, wherein the one or more grooves include two grooves axially spaced apart along the stinger, a first ring of the one or more rings being positioned within a first groove and a second ring of the one or more rings being positioned within a second groove.

12. The artificial lift system of claim 9, wherein the one or more slots comprise a plurality of slots equally spaced about a circumference of the matrix.

13. The artificial lift system of claim 9, wherein at least a portion of the stinger is circumferentially surrounded by the matrix.

14. The artificial lift system of claim 9, wherein the one or more magnetic components apply a magnetic force to one or more ferrous portions of the stinger at predetermined locations.

15. The artificial lift system of claim 9, wherein at least one of a bottom portion of the stinger or a top portion of the stinger is tapered.

16. A method, comprising:

positioning a plunger assembly within a wellbore;

securing a stinger of the plunger assembly in an open position using a magnetic positioning system, the stinger having a top end, a bottom end, and a connecting portion, the connecting portion having one or more grooves to receive one or more rings formed of a magnetic material;

causing, responsive to a first force, the stinger to move to a closed position; and causing, responsive to a second force, the stinger to move to the open position after the stinger is driven to a top portion of the wellbore.

17. The method of claim 16, wherein the stinger is driven toward a bottom portion of the wellbore responsive to flow through openings of the plunger assembly when the stinger is in the open position.

18. The method of claim 16, wherein the magnetic positioning system includes magnetic components that apply a force to the one or more rings of the stinger.

* * * * *